US005170891A

United States Patent [19]

Barrett

[11] Patent Number: 5,170,891

[45] Date of Patent: Dec. 15, 1992

[54] SELF-CLEANING MAGNETIC SEPARATOR

[75] Inventor: William T. Barrett, Greeneville, Tenn.

[73] Assignee: Venturedyne Limited, Milwaukee, Wis.

[21] Appl. No.: 763,303

[22] Filed: Sep. 20, 1991

[51] Int. Cl.[5] ..... B03C 1/14; B03C 1/12

[52] U.S. Cl. ..... 209/223.2; 198/619; 198/690.1; 198/657; 209/219; 209/221; 209/224; 209/225

[58] Field of Search ..... 209/219, 223.2, 228, 209/225, 226, 230, 636, 223.1, 224, 221; 210/222; 198/619, 690.1, 657

[56] References Cited

U.S. PATENT DOCUMENTS

| | | | |
|---|---|---|---|
| 462,321 | 11/1891 | Moffatt et al. | 209/226 |
| 466,513 | 1/1892 | Reed | 209/223.2 X |
| 1,056,318 | 3/1913 | Bruck | 209/223.2 X |
| 1,340,457 | 5/1920 | Newton | 209/223.2 X |
| 1,512,344 | 10/1924 | Lorang | 209/223.1 |
| 1,948,419 | 2/1934 | Granigg | 209/221 |
| 2,702,123 | 2/1955 | Injeski, Jr. | 209/223 |
| 2,979,202 | 4/1961 | Oberliani | 209/223 |
| 3,246,753 | 4/1966 | Laurila | 209/219 |
| 3,595,391 | 7/1971 | Schmid | 209/225 |
| 3,926,792 | 12/1975 | Buford | 209/636 |
| 3,952,857 | 4/1976 | Nazuka | 209/219 X |
| 4,597,860 | 7/1986 | Kukuck et al. | 209/223 |
| 4,784,759 | 11/1988 | Elliott | 209/223.1 |
| 4,818,378 | 4/1989 | Elliott | 209/225 |
| 4,867,869 | 9/1989 | Barrett | 209/223.2 |

FOREIGN PATENT DOCUMENTS

| | | | |
|---|---|---|---|
| 213926 | 10/1909 | Fed. Rep. of Germany | 209/223.2 |
| 284815 | 11/1990 | Fed. Rep. of Germany | 210/222 |

*Primary Examiner*—Donald T. Hajec
*Attorney, Agent, or Firm*—Jansson & Shupe, Ltd.

[57] ABSTRACT

The improved self-cleaning magnetic separator includes a tube and a conveying flight spiralled about the tube. The separator has a magnetic material collecting portion, a magnetic material discharge portion and a bar-like magnet providing a lobe-like magnetic field. The field is of generally uniform strength along the material collecting portion and diminishes in strength along the discharge portion. In a highly preferred arrangement, the magnet is stationary and the tube and flight rotate with respect to it. Because the magnetic material is "trapped" by the stationary field, such rotation causes the magnetic material to be urged by the flight from the collecting portion to the discharge portion. The field, of diminished strength in the discharge portion, permits magnetic material to fall away from the discharge portion. In one arrangement, the magnet has a shunt for diminishing the field strength to a very low value, zero or only slightly above, thereby configuring the separator for use even with very finely divided magnetic material.

20 Claims, 5 Drawing Sheets

SELF-CLEANING MAGNETIC SEPARATOR

FIELD OF THE INVENTION

This invention relates generally to article handling devices and, more particularly, to article sorting using magnetic separation.

BACKGROUND OF THE INVENTION

Magnetic separators are widely used to separate magnetic from non-magnetic materials. Magnetic separating systems have been used for some time to separate "particles" as large as crushed ore and to separate very fine, powder-like particles from a mixture containing both a primary product and the magnetic particles. Grate magnets are only one of a large class of magnetic separators and, typically, include several parallel V-shaped slots, each such slot opening to a magnet positioned just below and parallel to it.

Conventional grate magnets are attended by a number of problems. A major problem is that the magnetic separators must be cleaned periodically so that their separating capability (as represented by the "attracting power" of the magnetic field) is retained. And, of course, downtime needed for cleaning interrupts the smooth flow of the separating "line" and increases production costs.

If an electromagnet provides the separating magnetic field, such magnet can simply be turned off and the magnetic particles fall away. Residual magnetism can remain, however, and very small particles may not fall from the separator. And, presumably, the electromagnet is de-energized only under circumstances where the falling particles cannot contaminate the material from which they have been separated.

Another approach for cleaning grate magnets involves a magnetic rod positioned concentrically within a non-magnetic outer tube. For cleaning, the magnetic rod is withdrawn to permit magnetic particles to fall away. This principle is described in U.S. Pat. No. 4,867,869(Barrett).

The arrangement shown in U.S. Pat. No. 4,784,759(Elliott) uses a rotating, screw-like conveyor positioned inside a hollow stationary tube. A magnetic field is provided along the tube by four bar-like magnets which extend the length of the tube and are positioned around the outside of the tube about 90° from one another. The resulting force field is substantially symmetrical about at least eight planes, any of which includes the axis of rotation. Magnetic material is attracted to the inner side of the tube and urged upward for discharge. The screw conveyor is reversible and material can also be fed downward. In another embodiment, only two bar magnets are used along the length of the tube.

The arrangement shown in U.S. Pat. No. 4,818,378(Elliott) is something of an "inside out" version of that shown in the Elliott '759 patent discussed above. That is, a single rotating rod-like bar magnet is concentric within a stationary tube wrapped with one or two spiral ramps. As the interior magnet rotates, the magnetic material is advanced along the outer surface of the stationary outer tube.

The apparatus shown in U.S. Pat. No. 3,595,391(Schmid) uses an inclined rotating drum, the interior of which is fitted with spiral ribs. The mixture bearing the magnetic particles is placed inside the drum for separation. A magnet is positioned outside the drum and the attracted magnetic particles adhere to the side of the drum, are carried upward away from the magnet and finally dropped to the bottom of the drum. This progressive lifting and dropping of magnetic material causes the magnetic material to move toward the lower end of the drum as the non-magnetic material moves towards the upper end and is discharged.

The apparatus shown in U.S. Pat. No. 1,340,457(Newton) is very similar in operating principle to that shown in the Schmid patent. The common operating principle involves the use of a localized magnetic field provided by an electromagnet at one end of the separator and a rotating drum with spiral ribs to urge material in a particular direction.

A problem with magnetic separators of the foregoing types is that they must be taken out of service to be cleaned. In other words, production halts during cleaning. Another problem with certain known magnetic separators is that they tend to be suitable for only a relatively narrow range of magnetic particle sizes. If a magnetic separator is configured to attract and hold large particles, it is correspondingly less likely to give up its magnetic "fines" when cleaned.

OBJECTS OF THE INVENTION

It is an object of this invention to overcome some of the problems and shortcomings of the prior art.

Another object of the invention is to provide an improved magnetic separator which does not have to be taken out of production to be cleaned.

Another object of the invention is to provide an improved magnetic separator which is self-cleaning.

Still another object of the invention is to provide an improved magnetic separator useful to separate a wide range of sizes of magnetic particles from a mix including both magnetic and non-magnetic particles.

Another object of the invention is to provide an improved magnetic separator useful to separate magnetic particles from mixes having varying percentages of such particles.

Yet another object of the invention is to provide an improved magnetic separator suitable for use in a grate magnet. These and other objects of the invention will be apparent from the following description taken in conjunction with the drawing.

SUMMARY OF THE INVENTION

By way of general explanation, the invention uses retention or "capture" of magnetic particles by a magnetic field and urging of such particles toward a region of diminished field strength by use of a spiral conveyor "flight." The captured particles remain in the magnetic field until they reach a portion of the separator where the field strength becomes very low. There, the particles fall from the tube.

More particularly, the improved self-cleaning magnetic separator includes an elongate tube, preferably round in cross section, and a conveying flight spiralled around the tube. The flight is preferably attached to the tube along the entire length of the flight in a way that "fines" of magnetic material cannot pass under or become lodged between the flight and the tube. The tube and flight are concentric one to the other and have a magnetic material collecting portion and a magnetic material discharge portion. The separator is fed a mix of magnetic and non-magnetic materials and the magnetic materials adhere to the collecting portion, are moved to the discharge portion where the field strength weakens and there fall away from and are separated from the mix.

Magnetic means such as an elongate bar-like magnet provides a relatively sharply defined magnetic field which is lobe-like in shape when considered from an end of the tube. The field is of generally uniform strength along the material collecting portion and of diminished strength along the discharge portion. Either one of the spiral flight and the magnet is relatively rotatable with respect to the other. In one highly preferred embodiment, the conveying flight rotates and the magnet is stationary. With this arrangement, flight rotation moves the magnetic material from the collecting portion to the discharge portion in a generally straight line.

In another embodiment, the magnet rotates. As it does so, the magnetic particles bear against the flight and slide along it, defining a spiral path. Movement of magnetic material from the collecting portion to the discharge portion continues until the field strength surrounding such material is insufficient to hold it. At that time, it drops from the discharge portion. In this embodiment, the direction of spiral of the stationary flight, i.e., clockwise or counterclockwise, and the direction of rotation of the magnet are the same when considered from a particular end of the tube and from a point nearest to and moving away from such end.

The tube is hollow and includes a longitudinal centerline and an interior surface, the inside wall of the tube. The bar-like magnet is positioned between the centerline and the interior surface and for separators having a rotating conveying flight, the magnet is laterally outward from the longitudinal centerline, thereby optimizing the fines-collecting capability of the separator. If the conveying flight rotates clockwise (when viewed from the collecting portion toward the discharge portion), the magnet is at about the 3 o'clock position. On the other hand, if the conveying flight rotates counterclockwise (when viewed the same way), the magnet is at about the 9 o'clock position. For reasons explained below, such magnet position optimizes separation.

Another feature of the inventive separator is that the magnet and the tube diverge from one another along the discharge portion, thereby weakening the magnetic field strength along the discharge portion so that magnetic particles fall away. In a highly preferred embodiment, the tube is of generally uniform diameter along its length and the magnet diverges away from the tube wall and toward the tube centerline. In another preferred embodiment, the tube is cone-shaped or flared at the discharge portion and diverges away from the magnet. In either instance, tube-magnet divergence results.

It has been discovered that even with tube-magnet divergence, very finely divided particles of magnetic material, often called "fines," do not readily fall away from or separate from the discharge portion—at least with separators having reasonable tube-magnet spacing therebetween. Therefore, a highly preferred embodiment includes a magnetic shunt attached to the "discharge end" of the bar-like magnet. Such shunt creates a one turn, short circuited magnetic field and reduces the strength of the magnetic field at the fine-collecting surface of the tube to a level such that magnetic fines separate from the discharge portion.

For separators used with mixes having a relatively consistent percentage of magnetic to non-magnetic material, a constant rotation speed works well. However, where the percentage changes—or is apt to change—an adjustable speed drive is preferred. In that way, the conveyor flight or the magnet, as the case may be, is rotated at a speed adjustable in view of the anticipated percentage of magnetic material present in the mix. An example helps illustrate this aspect.

It is assumed that a particular rotational speed works well for a mix containing 5% magnetic particles. If that percentage is increased to, say, 25%, the magnetic particles accumulate rapidly on the separator and will likely develop a "tail" of such particles hanging from the separator. Such hanging particles are much more likely to fall or be knocked from the collection portion into the previously-cleaned non-magnetic material, thereby contaminating it.

In some applications, only relatively large magnetic particles are separated from the mix and the use to which the cleaned non-magnetic material is put is insensitive to bacterial or similar contamination. In such applications, the conveyor flight may be "tacked" to the tube at a few places and small spaces between the tube and flight are of no consequence.

However, there are certain applications such as separation of magnetic material, especially fines, from foodstuffs that are much more intolerant of contamination. In such applications, the flight is attached to the tube along the entire length of the flight. And attachment is in a way to leave no cracks or crevices in which material may lodge and contribute to contamination or through which fines may "escape" through a small space between the tube and the flight.

The improved separator may be used singly or plural separators may be oriented in parallel to provide a magnetic separation grate. In the latter instance, each such separator preferably includes a tube, conveying flight, a magnetic material collecting portion, a magnetic material discharge portion and magnetic means, all as described above with respect to preferred embodiments.

DETAILED DESCRIPTION OF PREFERRED EMBODIMENTS

Certain aspects of the new separator 10 involve "standing" magnetic fields in space (which are invisible) as well as one of either of two separator parts which rotates with respect to the other. The invention also involves a spiralled "conveyor" flight. The dynamic or operating interaction of these aspects is sometimes difficult to visualize. Therefore, the new separator 10 will be described initially by using only portions of the structure to illuminate certain principles. Following, other aspects of the new separator 10 will be explained in detail.

Figure 1:
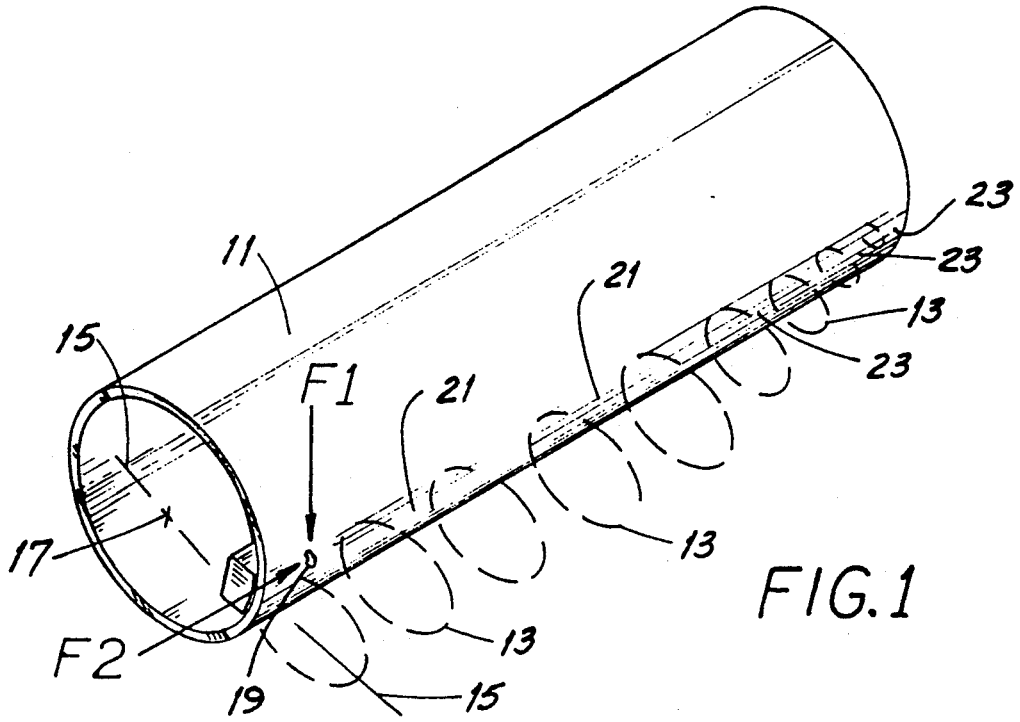
FIG. 1 is a perspective view of a portion of the new magnetic separator showing the orientation and general shape of the magnetic field and, representatively, the strength of such field.

FIG. 1 illustrates a separator tube 11 having a relatively sharply-defined, lobe-like magnetic field 13 along much of its length. This "standing" magnetic field 13 is represented by the dashed outlines and it is to be appreciated that such field 13 extends in a continuum rather than comprising discrete lobes. It is also to be noted that such field 13 is symmetrical about only a single plane 15 which includes the axis of rotation 17. For the moment, the means by which the field 13 is created is disregarded.

Magnetic particles 19 which fall into the field 13 are captured and retained. Because of magnetic attraction, it is difficult to dislodge the particles 19 from the field 13 by application of a downward force F1, tangent to the surface of the tube 11, as would be exerted by gravity. In other words, the particles 19 do not fall out of the field.

On the other hand, a relatively small horizontal force F2 applied to the particles 19 will urge them through and along the magnetic field in the collecting portion 21. The particles 19 slide along the tube 11 and remain captured in the magnetic field 13 until they reach a discharge portion 23 of the separator tube 11 where the field strength diminishes and becomes very low, perhaps zero or near zero. There, the particles 19 fall from the tube 11. And, of course, the point along the portion 23 at which the particles 19 fall from the tube 11 is a function of particle size and field strength. Heavier particles 19 fall at points nearer the portion 21 while fines fall at or near the far end of the portion 23.

Referring now to FIGS. 2, 3, 4 and 5, the improved self-cleaning magnetic separator 10 includes an elongate hollow tube 11, preferably round in cross section, and a conveying flight 25 spiralled around the tube 11. From the following description, it will be appreciated that in a highly preferred embodiment, the tube 11 and flight 25 rotate in unison and in the same direction to urge magnetic particles from the collecting portion 21 toward and into the discharge portion 23. Other embodiments are described later.

The tube 11 and flight 25 are of non-magnetic material, are concentric one to the other and have a magnetic material collecting portion 21 and a magnetic material discharge portion 23. If "fines" (very small particles 19) of magnetic material are to be separated from a mix 26 of magnetic and non-magnetic materials, the flight 25 is preferably attached to the tube 11 along the entire length of the flight 25. Attachment is in a way that such fines cannot pass under the flight 25 or become lodged between the flight 25 and the tube 11. The reason the manner of attachment is of concern is that in some applications, only relatively large magnetic particles 19 are separated from the mix 26 and the utility of the cleaned non-magnetic material is not impaired by bacterial or similar contamination. In such applications, the conveyor flight 25 may be "tacked" to the tube 11 at a few places and small spaces between the tube 11 and flight 25 where particles 19 can collect are of no consequence.

However, there are certain applications such as separation of magnetic material, especially fines, from foodstuffs that are intolerant of contamination. In such applications, the flight 25 is attached to the tube 11 along the entire length of the flight 25. And attachment is in a way to leave no cracks or crevices in which material may lodge and contribute to contamination or through which fines may "escape" through a small space between the tube 11 and the flight 25.

Figure 2:
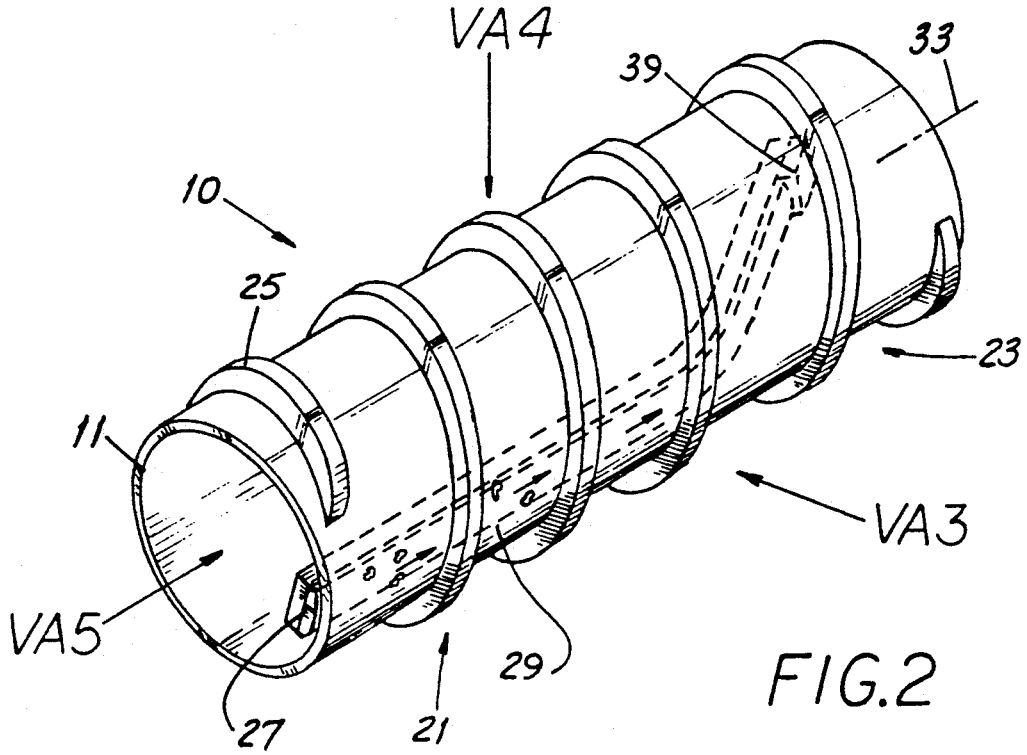
FIG. 2 is a perspective view of one embodiment of the invention with parts shown in phantom outline.
Figure 4:
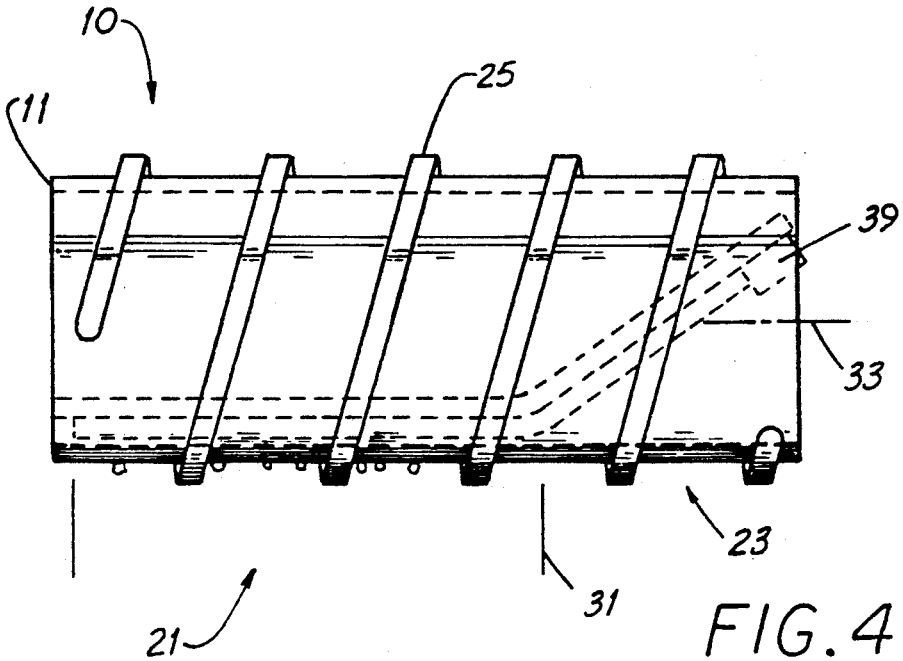
FIG. 4 is a top plan view of the embodiment of FIG. 2 taken along the viewing axis VA4 thereof.
Figure 3:
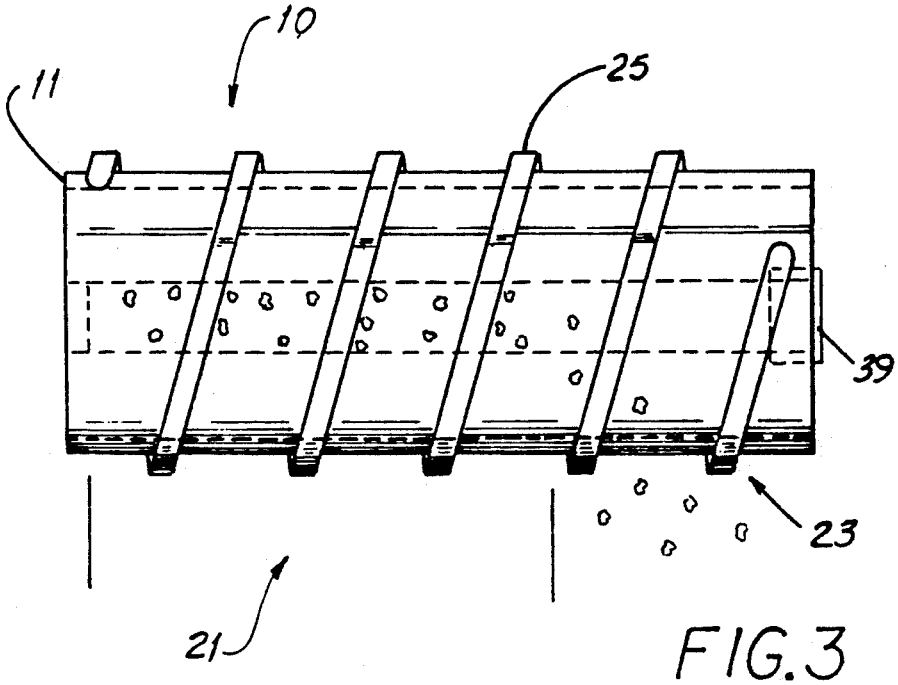
FIG. 3 is a side elevation view of the embodiment of FIG. 2 taken along the viewing axis VA3 thereof.
Figure 5:
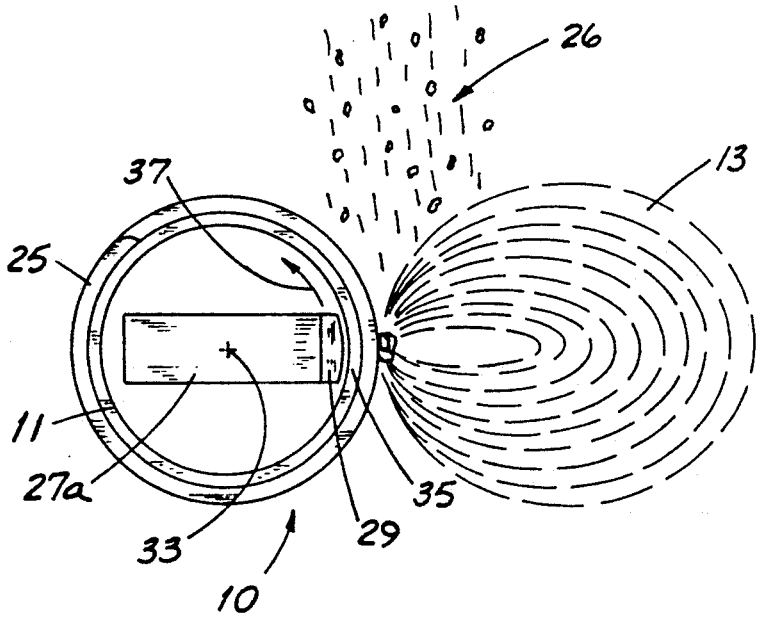
FIG. 5 is an end elevation view of the embodiment of FIG. 2 taken along the viewing axis VA5 thereof.

As particularly shown in FIGS. 1 and 5, magnetic means 27 such as an elongate bar-like magnet **27*a* provides a relatively sharply defined magnetic field 13 which is lobe-like in shape when considered from an end of the tube. As described in connection with FIG. 1, the field 13 is of generally uniform strength along the material collecting portion 21 and of diminished strength along the discharge portion 23. The generally uniform field shape and strength is by positioning a first length 29 of the magnet 27*a* immediately adjacent to but not in contact with the interior side wall of the tube 11 and along the collecting portion 21. Referring particularly to FIGS. 2 and 4, at the juncture 31 of the portions 21 and 23, the magnet 27*a* is bent inward toward and through the longitudinal centerline 33 of the tube 11**. The relevance of this configuration is explained below.

As best seen in FIG. 5 for best performance in a "top fed" separator, the first length 29 of the bar-like magnet **27*a* is positioned between the centerline 33 and the interior surface 35 of the tube 11 and laterally outward from such centerline 33, thereby optimizing the fines-collecting capability of the separator 10. If the conveying flight 25 rotates clockwise (when viewed from the collecting portion 21 toward the discharge portion 23, i.e., the perspective of FIG. 5), the first length 29 of the magnet 27*a* is at about the 3 o'clock position. On the other hand, if the conveying flight 25 is oppositely spiralled and rotates counterclockwise (when viewed the same way), the first length 29 is at about the 9 o'clock position. And it should be appreciated that urging of the angled flight 25 against a particle 19 is not only along the line defined by the magnetic field 13 but, preferably, is also downward to aid gravity in separating the particle 19 from the tube 11** when the field strength becomes sufficiently low.

Regarding the aforedescribed magnet position, it has been found that placing the magnet **27*a* at, say, 1 o'clock resulted in a significant loss of magnetic particles 19 into the non-magnetic product because the latter prematurely "knocked off" such particles 19. And the recovered magnetic particles 19** were unduly contaminated with non-magnetic particles.

On the other hand, placing the magnet **27*a* at, say, 5 o'clock resulted in mingling of magnetic particles 19 with the recovered non-magnetic product. However, little if any contamination of the magnetic particles 19** by non-magnetic material resulted. Therefore, the aforementioned approximately 3 o'clock magnet position optimizes separation.

With the arrangement described above, rotation of the tube 11 and flight 25 moves the magnetic particles 19 from the collecting portion 21 to the discharge portion 23 in a generally straight line. Considered another way, the flight 25 provides a force like force F2 against the particles 19 to urge them along. And other arrangements are possible. For example, the tube 11 and magnet **27*a* may be held stationary and the flight 25 rotated. In yet another arrangement, the tube 11 and flight 25 are stationary and the magnet 27*a* rotates. Referring further to FIG. 5, the magnet is rotated while maintaining the face of the first length 29 in the position (with respect to the interior surface 35) as shown in FIG. 5. As the magnet 27*a* rotates about centerline 33 (as represented by the arrow 37), the magnetic particles 19 are urged against the flight 25 and slide along it, defining a spiral path. Movement of magnetic particles 19 from the collecting portion 21 to the discharge portion 23 continues until the field strength surrounding such particles 19 is insufficient to hold them. At that time, they drop from the discharge portion 23. In this embodiment, the direction of "laying" the spiral of the stationary flight 25, i.e., clockwise or counterclockwise, and the direction of rotation of the magnet 27***a* are the same when considered from a particular end of the tube 11 and from a point nearest to and moving away from such end.

Figure 6:
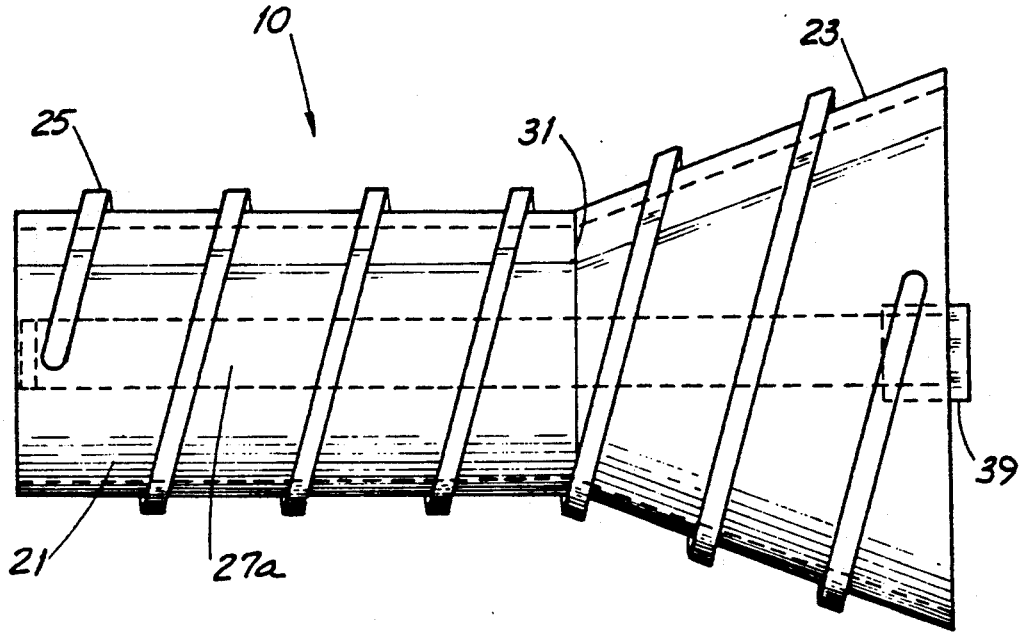
FIG. 6 is a side elevation view of another embodiment of the invention taken from the perspective of viewing axis VA3 of FIG. 2.

Referring again to FIGS. 2–4 and additionally to FIG. 6, the magnet 27*a* and the tube 11 diverge from one another along the discharge portion 23, thereby weakening the magnetic field strength along the discharge portion 23 so that magnetic particles 19 fall away. In a highly preferred embodiment of FIGS. 2–4, the tube 11 is of generally uniform diameter along its length and the magnet 27*a* is bent to diverge away from interior surface 35 of the tube 11 and toward and through the tube centerline 33. In another preferred embodiment, illustrated in FIG. 6, the tube 11 is cone-shaped or flared at the discharge portion 23 and diverges away from the magnet 27*a*. In either instance, tube-magnet divergence results.

Referring particularly to FIGS. 2 and 4, it has been discovered that even with tube-magnet divergence, fines do not readily fall away from or separate from the discharge portion 23—at least with separators 10 having reasonable tube-magnet spacing therebetween. Therefore, a highly preferred embodiment useful for separating fines includes a magnetic shunt 39 attached at or near the "discharge end" of the bar-like magnet 27*a*.- Such shunt 39 creates a one turn, short circuited magnetic field and reduces the strength of the magnetic field at the surface of the tube 11 to a level, zero or near-zero gauss, such that magnetic fines readily separate by falling away from the discharge portion 23.

Figure 7:
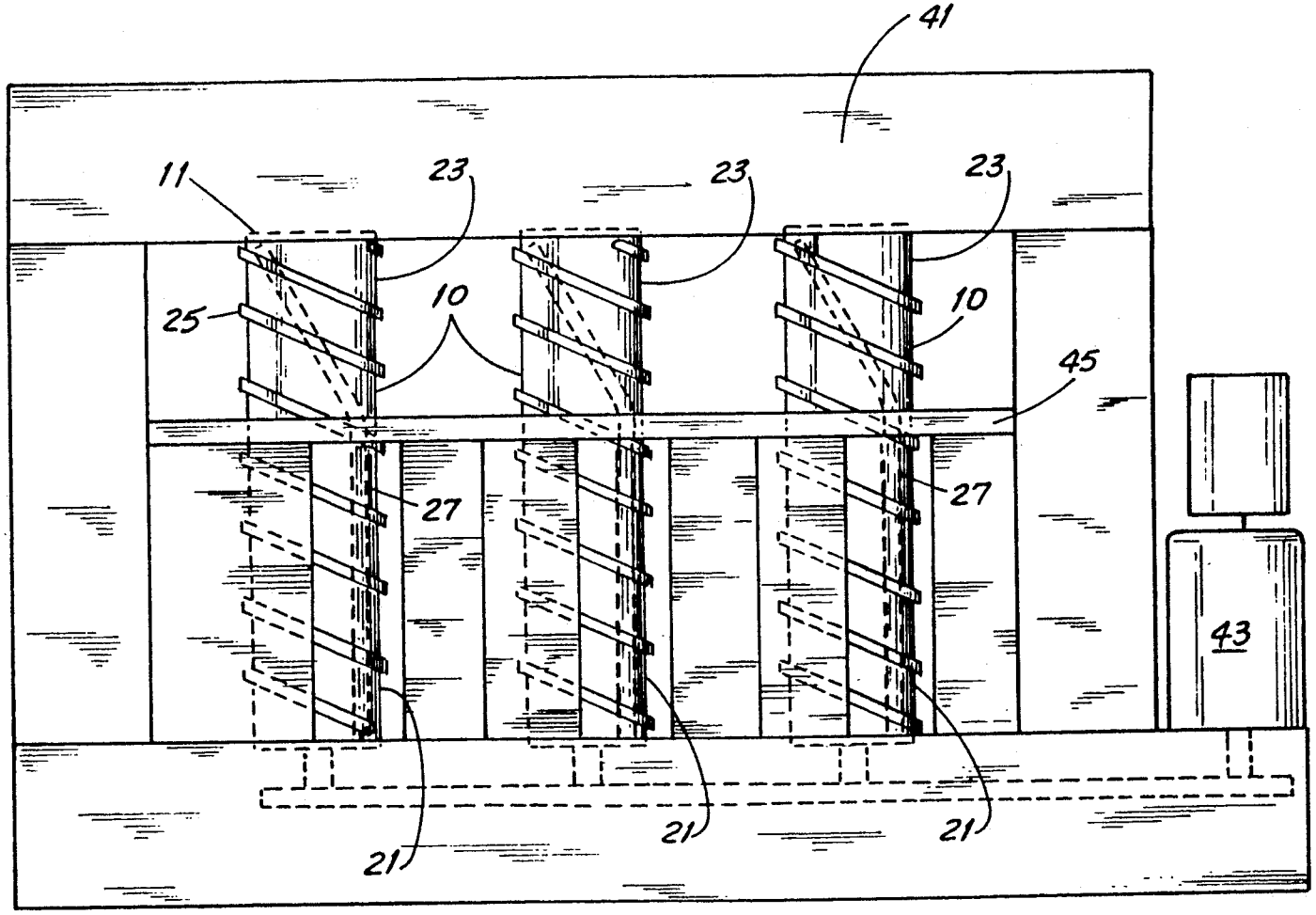
FIG. 7 is a top plan view of a grate-type magnetic separator incorporating the invention, with parts shown in phantom outline.

The improved separator 10 may be used alone or "ganged" in an improved magnetic separation grate 41 having a plurality of self-cleaning magnetic separators 10 as shown in FIG. 7. In the latter instance, each such separator 10 preferably includes a tube 11, conveying flight 25, a magnetic material collecting portion 21, a magnetic material discharge portion 23 and magnetic means 27, all as described above with respect to preferred embodiments. In the view of FIG. 7, the magnetic separation grate 41 includes three improved separators 10 oriented in parallel although the number of such separators 10 can vary widely. The separators 10 are "gang" driven by an adjustable speed drive 43 and a partition 45 separates the collecting portions from the discharge portions.

For separators 10 used with mixes 26 having a relatively consistent percentage of magnetic to non-magnetic material, a constant separator rotation speed works well. However, where the percentage changes—or is apt to change—an adjustable speed drive 43 is preferred. In that way, the conveyor flight 25 or the magnet 27*a*, as the case may be, is rotated at a speed adjustable in view of the anticipated percentage of magnetic material present in the mix 26. An example helps illustrate this aspect.

It is assumed that a particular rotational speed works well for a mix 26 containing 5% magnetic particles 19. If that percentage is increased to, say, 15%, the magnetic particles 19 accumulate rapidly on the separator 10 and will likely develop a "tail" of such particles 19 hanging from the separator 10 and held together by magnetic attraction. Such hanging particles 19 are much more likely to fall or be knocked from the collection portion 21 into the previously-cleaned non-magnetic material, thereby contaminating it.

Figure 8:
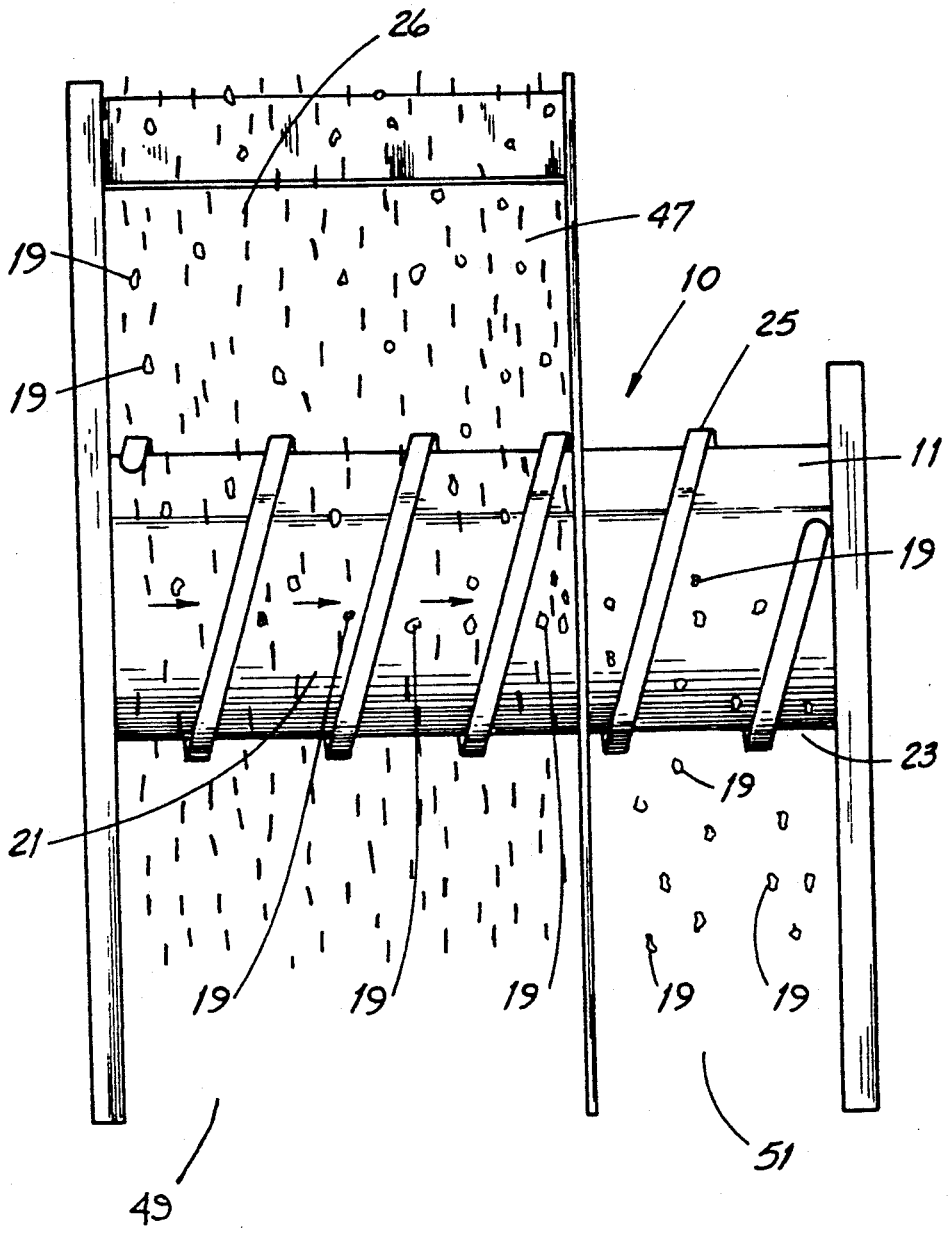
FIG. 8 is a representative cross-sectional side elevation view of a grate-type magnetic separator machine incorporating the invention.

FIG. 8 illustrates how the improved separator 10 operates. A mix 26 of magnetic and non-magnetic material is fed into the receiving hopper 47 to impinge upon the collecting portion 21—or portions 21 if the machine has plural separators 10. The magnetic particles 19 adhere thereto while the non-magnetic particles fall through and are collected, perhaps in a bin. The magnetic particles 19 are urged rightward toward the discharge portion 23 and fall from such portion 23 into the compartment 51. The point along the discharge portion 23 at which the particles 19 fall into the compartment 51 depends upon particle size and field strength. When separating fines, the magnetic means 27 includes the aforedescribed shunt 39 which reduces the field strength to zero or nearly zero at or near the right end of the discharge portion 23.

Merely as an example, one separator 10 uses a tube 11 two inches in diameter. The magnetic means 27 was constructed of rare earth magnets to provide a field strength at the outer surface of the tube 11 of about 3000 gauss. Such arrangement is highly satisfactory in recovering fines, even in mixes 26 with an elevated percentage of magnetic material. As will be appreciated by those of ordinary skill in the art after understanding the specification, design parameters may vary widely, depending upon the purpose for which the separator 10 is to be used.

While the principles of this invention have been described in connection with certain exemplary embodiments, those of ordinary skill will recognize other possible embodiments which are within the scope of the invention.

I claim:

1. An improved self-cleaning magnetic separator including:

a tube and a conveying flight concentric one to the other and having a magnetic material collecting portion and a magnetic material discharge portion;

a permanent magnet extending along the portions and providing a lobe-like magnetic field of generally uniform strength along the material collection portion and of diminished strength along the discharge portion, one of such flight and such magnetic means being relatively rotatable with respect to the other, whereby magnetic material moves from the collection portion to the discharge portion and separates from the discharge portion.

2. The separator of claim 1 wherein the conveying flight rotates, thereby moving the magnetic material from the collecting portion to the discharge portion.

3. The separator of claim 1 wherein the magnetic means rotates, thereby moving the magnetic material from the collecting portion to the discharge portion.

4. The separator of claim 1 wherein the tube is hollow and includes a longitudinal centerline and an interior surface and wherein the magnetic means includes a bar-like magnet between such centerline and the interior surface.

5. The separator of claim 4 wherein the conveying flight rotates and wherein the magnet is laterally outward from such longitudinal centerline, thereby optimizing the fines-collecting capability of the separator.

6. The separator of claim 5 wherein the conveying flight rotates clockwise viewed from the collecting portion toward the discharge portion and wherein the magnet is at about the 3 o'clock position.

7. The separator of claim 5 wherein the conveying flight rotates counterclockwise viewed from the collecting portion toward the discharge portion and wherein the magnet is at about the 9 o'clock position.

8. The separator of claim 1 wherein the magnetic means and the tube diverge from one another along the discharge portion.

9. The separator of claim 8 wherein the tube has a longitudinal centerline and is of generally uniform diameter along its length and wherein the magnetic means diverges away from the tube and toward the centerline.

10. The separator of claim 9 wherein the magnetic means includes an elongate bar-like magnet with a shunt for reducing the strength of the magnetic field to a level such that magnetic fines separate from the discharge portion.

11. The separator of claim 8 wherein the tube is flared at the discharge portion and diverges away from the magnetic means.

12. The separator of claim 1 wherein the separator is fed a mix of magnetic and non-magnetic materials and wherein the conveyor flight rotates at a speed adjustable in view of the anticipated percentage of magnetic material present in the mix.

13. The separator of claim 1 wherein the separator is fed a mix of magnetic and non-magnetic materials and wherein the magnetic means rotates at a speed adjustable in view of the anticipated percentage of magnetic material present in the mix.

14. The separator of claim 1 wherein the tube is of generally uniform diameter and wherein the flight is attached along substantially all of its length to the tube, thereby preventing magnetic fines from passing between the tube and the flight.

15. The separator of claim 2 wherein the magnetic means includes a permanently magnetized magnet.

16. The separator of claim 2 wherein the magnetic means includes an electromagnet.

17. An improved magnetic separation grate having a plurality of self-cleaning magnetic separators, each of which includes:

a tube and a conveying flight concentric one to the other and having a magnetic material collecting portion and a magnetic material discharge portion;

a permanent magnet extending along the portions and providing a lobe-like magnetic field of generally uniform strength along the material collection portion and of diminished strength along the discharge portion, one of such flight and such magnetic means being relatively rotatable with respect to the other, whereby magnetic material moves from the collection portion to the discharge portion and separates from the discharge portion.

18. An improved self-cleaning magnetic separator including:

a tube and a conveying flight concentric one to the other and having a magnetic material collecting portion and a magnetic material discharge portion, the tube having a longitudinal centerline and a generally uniform diameter along its length;

magnetic means providing a lobe-like magnetic field of generally uniform strength along the material collection portion and of diminished strength along the discharge portion, one of such flight and such magnetic means being relatively rotatable with respect to the other; and, along the discharge portion, the magnetic means diverges away from the tube and toward the centerline, whereby magnetic material moves from the collection portion to the discharge portion and separates from the discharge portion.

19. The separator of claim 18 wherein the magnetic means includes an elongate bar-like magnet with a shunt for reducing the strength of the magnetic filed to a level such that magnetic fines separate from the discharge portion.

20. An improved self-cleaning magnetic separator including:

a tube and a conveying flight concentric one to the other and having a magnetic material collecting portion and a magnetic material discharge portion;

magnetic means providing a lobe-like magnetic field of generally uniform strength along the material collection portion and of diminished strength along the discharge portion, one of such flight and such magnetic means being relatively rotatable with respect to the other;

the magnetic means and the tube diverge from one another along the discharge portion in that the tube is flared at the discharge portion and diverges away from the magnetic means, whereby magnetic material moves from the collection portion to the discharge portion and separates from the discharge portion.

* * * * *